United States Patent [19]

Savonjousi

[11] Patent Number: 4,515,318

[45] Date of Patent: May 7, 1985

[54] METHOD FOR CONTROLLING A PISTON FED WOOD GRINDER

[75] Inventor: Aslak Savonjousi, Espoo, Finland

[73] Assignee: Kymi-Stromberg Oy, Helsinki, Finland

[21] Appl. No.: 561,139

[22] PCT Filed: Nov. 5, 1980

[86] PCT No.: PCT/FI80/00005

§ 371 Date: Jul. 1, 1981

§ 102(e) Date: Jul. 1, 1981

[87] PCT Pub. No.: WO81/01303

PCT Pub. Date: May 14, 1981

Related U.S. Application Data

[63] Continuation of Ser. No. 280,006, Jul. 1, 1981, abandoned.

[30] Foreign Application Priority Data

Nov. 8, 1979 [FI] Finland ..... 793500

[51] Int. Cl.[3] ..... B02C 25/00

[52] U.S. Cl. ..... 241/28; 241/34; 241/35; 241/282

[58] Field of Search ..... 241/28, 30, 34, 280, 241/282, 35

[56] References Cited

U.S. PATENT DOCUMENTS

| | | | |
|---|---|---|---|
| 3,314,615 | 4/1967 | Hill | 241/34 |
| 3,599,154 | 8/1971 | Carol, Jr. et al. . | |
| 3,690,568 | 9/1972 | Alexander | 241/34 X |
| 3,693,891 | 9/1972 | Remmer | 241/28 X |
| 3,776,475 | 12/1973 | Perry | 241/282 X |

FOREIGN PATENT DOCUMENTS 1317260 5/1973 United Kingdom .

OTHER PUBLICATIONS

Int'l. Mech. Pulping Conf. Helsinki, 1977, Proceedings, vol. 111 Sess. 4 & 5.

Tampella Grinding Meter TGM, Tampella AB, Eng. Works, Tampere, Finland.

*Primary Examiner*—Mark Rosenbaum

*Attorney, Agent, or Firm*—Murray Schaffer

[57] ABSTRACT

The speed of feed movement of a piston is controlled to an essentially constant value by direct digital measurement of the actual speed, by comparing the actual value to a preset value and by compensating for differences therebetween. Variations in the piston feed pressure and in the grinding power are taken into account by means of additional signals related to these factors and added to or subtracted from the signal representing the actual value of the speed of the piston.

5 Claims, 3 Drawing Figures

METHOD FOR CONTROLLING A PISTON FED WOOD GRINDER

This is a continuation of U.S. Ser. No. 280,006 filed July 1, 1981 now abandoned.

BACKGROUND OF THE INVENTION

The present invention relates to a method for controlling a piston fed wood grinder, wherein a plurality of wood charges are fed by pressure medium driven pistons against stones for grinding.

Previously the work of a piston fed wood grinder has been controlled by maintaining the feed pressure of the pistons or the feed power of the pistons at a constant value or by maintaining the control valve of the feed pressure in a constant position. These earlier methods have the common advantage of being realizable in a simple manner. On the other hand they have the common serious draw-back that due to unevenness in the quality of the wood to be ground the rate of movement of the piston will vary, wherefore the pulp produced will not be of uniform quality. The importance of uniform quality of the pulp, again, has in recent times steadily grown.

Although this problem had been recognized a long time ago, no satisfactory solution has been found by means of which the rate of movement of the piston would be maintained essentially constant; one reason for this being that the feed piston moves very slowly and speed changes which may be absolutely small in toto relatively great have been difficult to observe and to compensate for.

It is the object of the present invention to provide a new control method which overcomes the afore mentioned difficulties.

SUMMARY OF THE INVENTION

The object is achieved by means of the method according to the present invention which is characterized in that the rate of feed movement of each piston is controlled to an essentially constant value on the basis of determining the rate of movement of the piston by direct digital measurement.

Preferably the rate of the feed movement of the piston is determined on the basis of each time interval between two consecutive digital pulses.

The time intervals occurring between the pulses are processed in a computer by division or by means of a calculator performing the corresponding work to a value of the rate of feed movement and in this manner the value is readily available for the control process. In practice the measured value of the rate of feed movement is received in a time less than 100 milliseconds and still at a great accuracy, the error being less than 2%, and thereby it has became possible to control the rate of feed movement for each feed unity in such a way that it is possible to grind at an optimal rate all the time.

The digital rate measurement can be performed e.g. by means of a rack coupled to the feed piston, the rack rotating a wheel the circumference of which moves past a pulse emitter trigging pulses at a rate proportional to the speed of the piston. The pulse emitter may e.g. be a photo-electric device, whereby the circumference of the wheel is provided with alternating zones permeable and impermeable to light.

As mentioned before, the rate of feed movement of the piston is varied to a great extent in control methods based on a constant feed pressure or a constant power. In case one rigidly tries to maintain a certain optimal rate of feed movement there will correspondingly be a risk of overloading the grinder, of dropping out of balance or of dropping out of the network completely.

In order to avoid these situations it is preferable to complement the control signal based on the measured rate of movement of each piston by an additional signal related to the feed pressure, whereby a more even distribution of the feed pressure between different pistons is achieved, and/or by an additional signal related to the power acting at the piston grinding stone, whereby overloading and the grinder dropping out of balance are avoided. In each case the rate of feed movement of the piston is regulated smaller when approaching preset limit values for the pressure or the power, the changes of the rate movement are still small and even whereby the quality of the produced pulp remains uniform.

In addition to these complementary signals the feed control can take into account an additional signal relating to the over-all power of the grinder, in order to prevent the grinder from dropping out of the network completely.

BRIEF DESCRIPTION OF DRAWINGS

In the attached drawing:

A grinder generally comprises two grinding stones designated by reference numerals 1 and 2. The stones are rotated by a common electrical motor 3. Reference numeral 4 designates a wood charge to be ground against the stone 1 in a pocket. FIG. 1 shows only one such wood pocket, although in reality there are two wood pockets for each grinding stone. Numeral 5 designates a piston which forces the pocket against the grinding stone; numeral 6 designates a device by which the pressure of the piston may be measured; numeral 7 designates an actuating device; and numeral 8 a regulating device. The actuating device 7 controls a feed valve for the piston 5 on a basis of the order received from the regulating device 8. The order of the regulating device 8 is normally determined by the difference between a preset value and a real value of the rate of movement, the latter being represented by the measured signal. Upon approaching the preset limit value of the pressure of an individual piston or the over-all power of the wood grinder an additional signal relating to the piston pressure and/or the over-all power of the grinder influences the regulating device in a manner described in more detail in the following with reference to FIGS. 2 and 3.

In FIG. 2 each of the full lines 9, 10 and 11, 12 represents the normal operation of one piston. Lines 9 and 10 represent the piston pair of a first stone, lines 11 and 12 the piston pair of a second stone. The distances between the lines have been exaggerated for the sake of clarity; in reality line 9 nearly coincides with line 10, and line 11 with line 12. The piston pairs of different grinding stones have a somewhat greater difference in rate due mainly to differences in the wear of the grinding stones. When the pressure of any piston rises near to the preset limit the operation changes in the way indicated by the dotted lines. The operation of each piston is in this case independent of the other pistons.

In FIG. 3 the vertical full lines 13, 14 and 15, 16 correspondingly represent the normal operation of the wood grinder. The same situation is indicated by the vertical full line 17 with respect to the over-all power of the grinder. Upon approaching the preset upper limit of the over-all power of the grinder the operation of all pistons change in the way indicated by the dotted lines. In such a case where the preset upper limit of the over-all power of the grinder is arrived at in spite of the additional signal related to said power, the operation shifts from control on the basis of rate of the pistons to power control, which situation is indicated by horizontal full line 18. In this manner the wood grinder is prevented from overloading or from dropping out of the network completely. This may be achieved e.g. by providing a power-regulator or a power regulation function in parallel or in series with the regulating device 8, whereby after these and before the actuating device 7 is provided a selecting member or a selection function which depending on the magnitude of the signals determines whether the movement of the grinder piston is to be controlled on the basis of the rate of movement or of power. The selecting member or selection function may be a cascade selection amplifier, a minimum or a maximum selection amplifier, the corresponding function realized as a computer programme or another device performing the said function. These are all well known to men skilled in the art.

Figure 1:
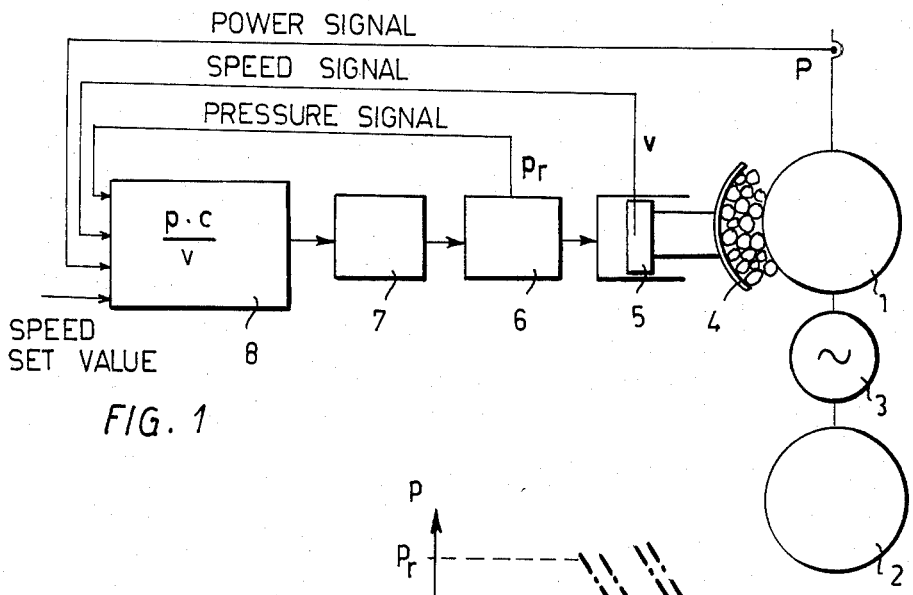
FIG. 1 is a block diagram illustrating the present invention.
Figure 2:
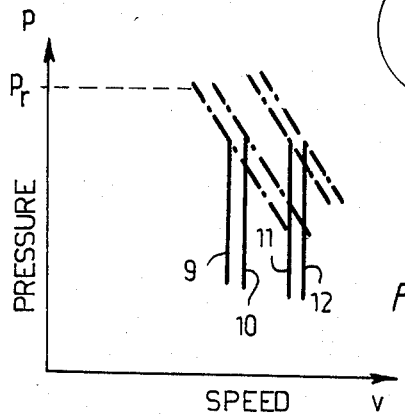
FIG. 2 is a graph illustrating the influence of the additional signal related to the pressure of a piston, on the operation of the grinder.
Figure 3:
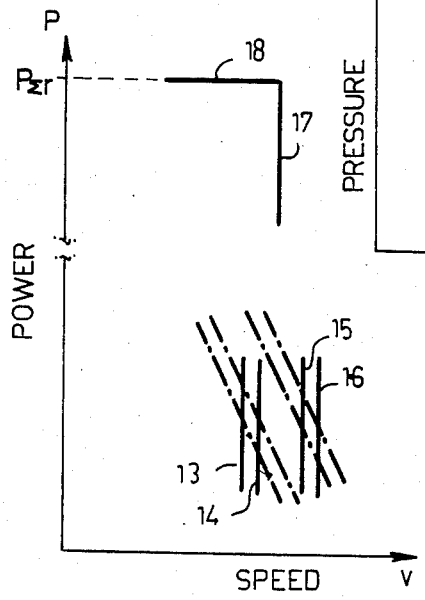
FIG. 3 is a graph illustrating the influences of the additional signals related to the power of the grinder.

The foregoing has described the embodiment of the invention which is believed to be the preferable one. There are, however, cases where a satisfactory control can be achieved on the basis of the signal related to the rate of piston movement only. Likewise there may be cases where either the additional signal related to the piston pressure or the additional signal related to the power of the grinder can be deleted.

I claim:

1. A method for controlling a piston fed wood grinder, wherein a plurality of wood charges are fed by pressure media driven pistons against a motor driven grinding stone comprising the steps of driving each of said pistons toward said grinding stone, determining a value for the actual speed of movement between selected positions of each of the pistons by direct digital measurement and comparing the value of the actual speed with a predetermined value indicative of a desired speed, simultaneously comparing the consumption of power by the motor driving grinding stone with a predetermined limit value indicative of the overload of the motor driving said grinding stone, controlling the pressure media driving said piston as a function of the difference between the value of the actual speed of the piston and said desired speed value to maintain said piston at a substantially constant speed so long as the power consumption is below the predetermined overload limit and upon said power consumption reaching the overload limit automatically shifting the control of the pressure media driving said piston as a function of the power consumption to vary the speed of said piston until the power consumption falls below the predetermined overload limit and thereafter returning control of said pressure media driving said piston as a function of the difference between the value of the actual speed of said piston and the predetermined value of the desired speed.

2. The method according to claim 1, wherein the digital measurement includes the steps of producing a series of digital pulses indicative of the movement of said piston and the speed of the piston is obtained by measuring the time interval between selected ones of two consecutive pulses.

3. The method according to claim 2, including the step of controlling the movement of said piston to maintain said piston at a constant power relative to said grinding stone upon the determination that the piston has reached the preset speed.

4. The method according to claim 1, including the step of determining a value indicative of the feed pressure of said piston and adding or subtracting said value of the feed pressure to the actual value of the speed of said piston.

5. The method according to claim 1, including the step of determining a value indicative of the grinding power of said piston, and adding or substracting said value of the grinding power to the actual value of the speed of said piston.

* * * * *